US009696120B1

(12) United States Patent
Moser et al.

(10) Patent No.: US 9,696,120 B1
(45) Date of Patent: Jul. 4, 2017

(54) SHOCK TRANSFER ARMOR

(71) Applicant: The United States of America, as represented by the Secretary of the Navy, Washington, DC (US)

(72) Inventors: Alex E. Moser, Washington, DC (US); David L. Knies, Marbury, MD (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 34 days.

(21) Appl. No.: 15/355,124

(22) Filed: Nov. 18, 2016

Related U.S. Application Data

(63) Continuation-in-part of application No. 13/921,648, filed on Jun. 19, 2013, now Pat. No. 9,534,870.

(60) Provisional application No. 61/777,511, filed on Mar. 12, 2013, provisional application No. 61/662,075, filed on Jun. 20, 2012.

(51) Int. Cl.
*F41H 5/02* (2006.01)
*F41H 7/00* (2006.01)
*F41H 5/04* (2006.01)

(52) U.S. Cl.
CPC ..... *F41H 5/02* (2013.01); *F41H 5/0492* (2013.01); *F41H 7/00* (2013.01)

(58) Field of Classification Search
CPC ... F41H 5/06; F41H 5/013; F41H 5/24; F41H 5/02; F41H 5/00; F41H 7/04; F41H 7/02; F41H 7/048; F41H 7/042; F41H 7/044; F41H 7/046
See application file for complete search history.

(56) References Cited

U.S. PATENT DOCUMENTS 3,566,741 A * 3/1971 Sliney ..... B21C 23/22 109/1 R
3,649,426 A * 3/1972 Gates, Jr. ..... E04B 1/62 109/84
3,794,277 A * 2/1974 Smedley ..... F16F 7/127 174/161 R
3,884,127 A * 5/1975 Simmons ..... B64C 13/42 91/509
4,185,542 A * 1/1980 York ..... B64C 13/36 92/166
4,283,987 A * 8/1981 Stichling ..... B01J 3/002 89/1.14
4,449,446 A * 5/1984 Degnan ..... B64C 13/36 89/36.02
4,608,912 A * 9/1986 Navarette ..... F15B 15/1466 89/36.02
5,014,603 A * 5/1991 Navarette ..... F15B 15/1452 188/381
5,102,723 A * 4/1992 Pepin ..... B32B 7/04 244/133
5,225,622 A * 7/1993 Gettle ..... E04B 1/82 102/303

(Continued)

*Primary Examiner* — Benjamin P Lee
(74) *Attorney, Agent, or Firm* — US Naval Research Laboratory; Roy Roberts

(57) ABSTRACT

An armor system includes a plate operably connected to a plunger, one or more solid bars of brittle material operably contained within a channel or tube, wherein the armor system is configured so that upon impact of a blast shock wave upon the plate, the plate transfers the blast shock wave to the plunger and then to the contents of the channel. Optionally, the channel also contains HFRM.

7 Claims, 5 Drawing Sheets

(56) References Cited

U.S. PATENT DOCUMENTS 5,394,786 A * 3/1995 Gettle ..... E04B 1/82 102/303
7,437,987 B1 * 10/2008 Ohnstad ..... F42D 5/045 244/114 B
7,841,268 B2 * 11/2010 Bailey ..... E02B 3/108 405/114
8,091,692 B2 * 1/2012 Deshmukh ..... F16F 9/003 188/267.2
8,205,703 B2 * 6/2012 Halliday ..... F41H 7/048 180/89.1
8,316,752 B2 * 11/2012 Waddell, Jr. ..... F42D 5/045 86/50
8,522,664 B2 * 9/2013 Chen ..... A43B 7/32 2/2.5
8,573,571 B2 * 11/2013 Langhorst ..... F16F 7/121 267/136
8,590,437 B2 * 11/2013 Gettle ..... F41H 5/0442 89/36.02
8,820,493 B2 * 9/2014 Parida ..... B61G 11/12 188/268
9,121,674 B2 * 9/2015 Wilson ..... F41H 5/04
9,452,784 B2 * 9/2016 Batt ..... F41H 7/042
2004/0118271 A1 * 6/2004 Puckett ..... F41H 5/0428 89/36.02
2004/0154463 A1 * 8/2004 Edberg ..... F42D 5/045 89/36.04
2008/0190276 A1 * 8/2008 Barger ..... F41H 5/007 89/36.02
2008/0250916 A1 * 10/2008 Bailey ..... E02B 3/108 89/36.02
2009/0005274 A1 * 1/2009 Swartele ..... C10M 169/04 508/110
2010/0307329 A1 * 12/2010 Kaswen ..... F16F 9/06 89/36.08
2011/0174144 A1 * 7/2011 Kuchinsky ..... F42D 5/045 89/36.02
2012/0174756 A1 * 7/2012 Wilson ..... F41H 5/04 89/36.02
2012/0216670 A1 * 8/2012 McDonald ..... F41H 5/023 89/36.02
2014/0007761 A1 * 1/2014 Haidar ..... F41H 7/042 89/36.02
2014/0150636 A1 * 6/2014 Baron, Sr. ..... F41H 5/0457 89/36.02

* cited by examiner

SHOCK TRANSFER ARMOR

CROSS-REFERENCE TO RELATED APPLICATIONS

This Application claims the benefit of US. Provisional Application Nos. 61/662,075 and 61/777,511 filed on Jun. 20, 2012 and Mar. 12, 2013, respectively, and of U.S. patent application Ser. No. 13/921,648 filed on Jun. 19, 2013, each of which is incorporated herein by reference in its entirety. Note that some terminology has been clarified in the present application with respect to U.S. patent application Ser. No. 13/921,648—in the event of an apparent conflict, the language in the present application is controlling.

BACKGROUND

In order to reduce harm to persons and property, it is desirable to mitigate high intensity impulses such as from blasts and projectiles. These impulses can arise from IEDs (Improvised Explosive Devices), mines, and the like.

BRIEF SUMMARY

An armor system includes a channel containing one or more solid bars of brittle material, and a plunger having one end inside the channel and an opposite end operably connected to a plate, wherein the armor system is configured such that upon impact of a blast shock wave upon the plate, the plate transfers the blast shock wave to the plunger and thence to the contents of the channel. Optionally, the channel also contains a high fluid retaining material (HFRM).

An armored vehicle includes a plate on the underside of the vehicle, a channel substantially orthogonal to the plate and containing one or more solid bars of brittle material, and a plunger having one end inside the channel and an opposite end operably connected to the plate, wherein the armor system is configured such that upon impact of a blast shock wave upon the plate, the plate transfers the blast shock wave to the plunger and thence to the contents of the channel.

BRIEF DESCRIPTION OF THE DRAWINGS

FIG. 1B illustrates a channel including a plate, plunger, solid bars of brittle material, and HFRM assemblage. The left image, FIG. 1A, is a magnified view showing a cross-section of HFRM filled above the top of the solid bars within the channel. The right image, FIG. 1C, is a magnified view showing a cross-section of top of bars of solid brittle material—in this embodiment, the bars take the form of cylinders.

DETAILED DESCRIPTION

Definitions

Before describing the present invention in detail, it is to be understood that the terminology used in the specification is for the purpose of describing particular embodiments, and is not necessarily intended to be limiting. Although many methods, structures and materials similar, modified, or equivalent to those described herein can be used in the practice of the present invention without undue experimentation, the preferred methods, structures and materials are described herein. In describing and claiming the present invention, the following terminology will be used in accordance with the definitions set out below.

As used in this specification and the appended claims, the singular forms "a", "an," and "the" do not preclude plural referents, unless the content clearly dictates otherwise.

As used herein, the term "and/or" includes any and all combinations of one or more of the associated listed items.

As used herein, the term "about" when used in conjunction with a stated numerical value or range denotes somewhat more or somewhat less than the stated value or range, to within a range of ±10% of that stated.

As used herein, the term "high fluid retaining material" or "HFRM" refers to a material that is able to absorb from 50% to up to 1000% of its weight in water.

DESCRIPTION

Mitigation of high intensity impulses from blasts caused by improvised explosive devices (IEDs) or land mines is critical to prevent injury to warfighters and non-combatants. For blast mitigation, it can be shown from first principle momentum and energy conservation arguments that the minimum momentum and kinetic energy transfer occurs for a maximum inelastic collision. To accomplish this requires a structure that both maximizes energy dissipation and provides ideal coupling.

As described herein and in a related application entitled "Materials and Processes for Coupling Impulses and Shockwaves into Solids," appliqués are developed to better match the impedance of the shock wave and blast products while allowing for energy dissipation. In one embodiment, the two functions (dissipation and coupling) are provided into two separate appliqués, however, it is possible to integrate the two functions into a single applique.

Figure 3:
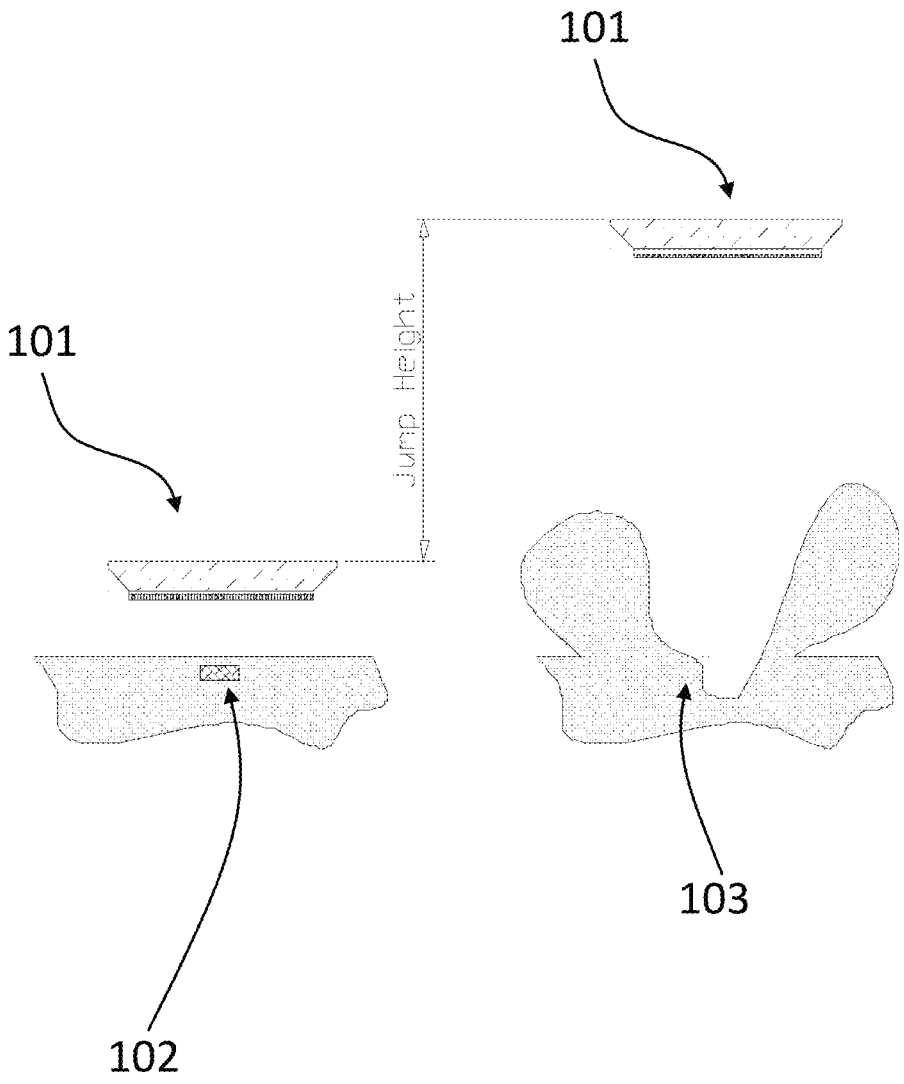
FIG. 3 schematically illustrates a test configuration.

Jump height provides relevant and reliable data associated with blast testing of the device under test (DUT). An exemplary jump height test configuration is shows in FIG. 3. With the armor system 101 under test positioned above the simulated threat 102, a blast 103 is triggered, causing the armor system 101 to jump. The jump height is used to calculate momentum and energy transfer to the DUT by assuming the DUT starts at rest, and is again at rest at the maximum jump height. At this point, the kinetic energy imparted to the DUT by the threat is converted to potential energy.

Armor System Design

One example of impulse mitigation involves a solid brittle material, such as glass, fracturing, adsorbing energy from the impulse, and preventing the impulse energy from harming personnel and equipment (see U.S. Pat. No. 8,176,831 and US Patent Publication Nos. 2011/0203452 and, each of which is incorporated herein by reference).

High fluid retaining materials (HFRM) such as sodium polyacrylate (NAPA) and polyvinyl alcohol (PVA) are able to absorb 50% to 800% or in some cases up to 1000% their weight in water, depending on process conditions and environmental factors. Normally, bulk water and other fluids that are shear thickening can be utilized to amplify, rather than mitigate a blast wave, due to several factors including water coherently vaporizing at its interface upon passage of a blast wave through its bulk and pressure dependent hydrogen bonding. Thus, it is undesirable to use a contiguous gel or fluid in the armor system.

However, a HFRM made of small distributed volumes such as spheres or fibers adjacent to voids (air) would react to a blast wave in a non-coherent manner, i.e., vaporization of retained fluid would occur at different rates throughout the distributed system and counter act the blast pressure wave rather than reinforce it. This distributed system would have a surface area per unit volume orders of magnitude greater than a bulk fluid structure, enabling a significantly greater aggregate transformation rate of the fluid to its vapor phase, and as a result, absorb a significant portion of the blast wave energy. In addition, these materials are also shear thinning that is the viscosity decreases with increased stress allowing the momentum and energy of the shockwave to be transferred through the medium. Further, materials such as water vapor, experiencing blast wave pressures and temperatures can undergo transformation to a supercritical fluid state, lowering their viscosity and resistance to flow significantly.

Beads or pellets of HRFM material are commercially available in a wide variety of sizes. In one embodiment, beads exist in a dry form with the majority having sizes between 15. um and 50. um, swelling with water to about 3 mm. Larger pellets may be used, such as those of about 2 cm. Preferably, the HRFM is fully hydrated or nearly fully hydrated (e.g., about 99.9%, 99%, 98%, 95%, or 90% hydrated).

In a soil blast test, jump height was reduced from 182 inches in a control to 134 inches when using NAPA, a reduction of 25%.

Additionally, the distributed HFRM can be used to redirect the blast wave momentum away from a volume designated for personnel, such as the volume of a troop transport vehicle; the mine resistant ambush protected (MRAP) vehicle. In non-dissipative systems momentum is constrained to be conserved. Thus, the momentum of the initial blast wave must be conserved as that momentum is transferred to the vehicle. The vaporized fluid from the HFRM significantly lowers the HRFM's viscosity allowing it to flow in rapid response to pressure gradient components of the blast wave, and if the armor structure is design appropriately, redirect the momentum and energy of the blast wave away from the vehicle compartment as shown in FIG. 4.

Figure 4A:
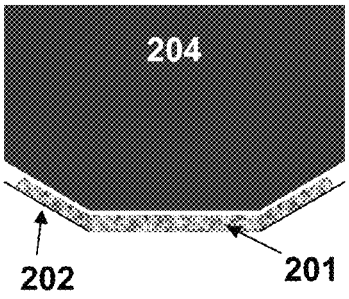
FIGS. 4A and 4B schematically illustrate a high fluid retaining materials (HFRM) system before blast (FIG. 4A) and during blast (FIG. 4B).
Figure 4B:
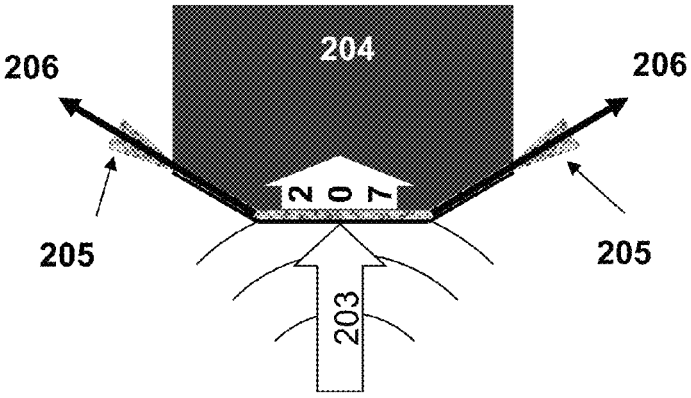
Figure 5:
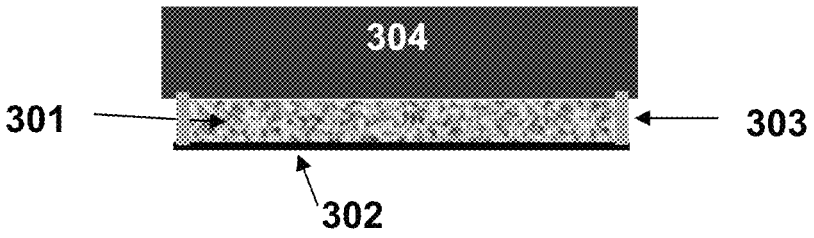
FIG. 5 schematically illustrates another embodiment wherein HFRM material is affixed to the bottom of a protected structure (such as a vehicle) having a flat bottom.

Such an embodiment shown is illustrated in FIG. 4, where a plate or other suitable container 202 holds the HRFM 201 in position around the vehicle compartment. In a case of a blast, the blast wave momentum 203 is directed away from the vehicle compartment 204 as the HFRM jets 205 redirect the momentum vector 206, resulting in low transfer of momentum 207 to the vehicle compartment. The vector momentum summation is directed through the vehicle compartment, but this sum vector is virtual and has little if any direct effect on personnel residing within the compartment. The plate 202 holding the NAPA or other HRFM in place can be made of metal or other materials such as plastics, or other composite or laminate structures; it merely is required to have enough structural integrity to maintain fieldability.

In blast testing of an embodiment as shown in FIG. 4, using sodium polyacrylate (NAPA) in water mounted on a plate with 45° plate wings decreased jump height from 234 inches in the control to 106 inches, a decrease of 54%.

FIG. 2 illustrates another embodiment wherein HFRM material is affixed to the bottom of a protected structure (such as a vehicle) having a flat bottom. The HRFM 301 is contained by a thin plate 302 (for example, made of metal, polymer, composite, and/or laminate) and thin-walled material on the sides 303 to allow the side walls to blow out, protecting the vehicle compartment 304 in the event of a blast. In this embodiment, the HFRM material system acts primarily as an energy absorbing material. The kinetic energy of the material and the vaporization of the fluid absorbed in the material serve to absorb blast energy.

Incorporating One or More Solid Brittle Bars

In addition to or in place of the one or more of the armor elements described herein, it is possible to include a channel containing a plunger, one or more solid brittle bars (comprising glass, ceramic, or a mixture thereof) designed to adsorb energy through a number of processes including fracture, and a optionally a high fluid retaining material (HFRM) such as sodium polyacrylate (NAPA) material surrounding the solid brittle bars. In embodiments, the channel is configured vertically with respect to the typical orientation of a vehicle.

Figures 1A, 1B, 1C:
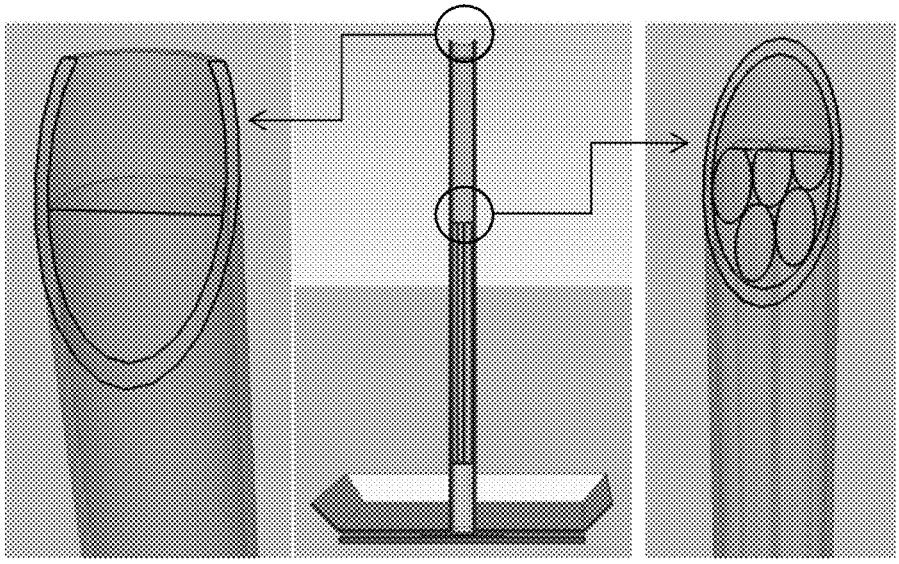
FIGS. 1A through 1C schematically illustrate an embodiment with bars of brittle material. The center image.

Such embodiments are shown in FIGS. 1A through 1C. The center image, FIG. 1B illustrates a channel including a plate, plunger, solid brittle material, and HFRM assemblage. The left image, FIG. 1A, is a magnified view showing a cross section of HFRM filling above the level of the solid brittle material within the channel. The right image, FIG. 1C, is a magnified view showing a cross-section of top of solid brittle material bars. In this case they are contained within a channel comprised of a metal tube. The image shows 7 solid cylinders, but any number can be accommodated from 1 to a bundle of solid brittle bars or rods or combination thereof, for example having diameters similar to fiber optic wire. Similarly, the channel can have a round cross section as in the drawing, or another shape such as square or rectangular.

The basin-like structure with the 45° angled sides serves as a representation of the vehicle underbody. There is a large plate under the vehicle body that may contain HFRM material. This plate is preferably comprised of a metal, metal alloy, metal matrix composite, and the like that functions to contain energy absorbing material such as HFRM. It may or may not be shaped to conform to the vehicle underbody shape; in this case the plate does not conform to the vehicle 45° angled sidewall. Atop the large plate is a smaller plate. This plate is comprised of a metal, metal alloy, metal matrix composite, and the like that functions to have appropriate structural integrity to transfer the blast shock wave to the plunger. Atop the small plate is a plunger. The plunger is comprised of a metal, metal alloy, metal matrix composite, and the like that functions to have appropriate structural integrity to transfer the blast shock wave to the solid brittle material. Atop the plunger is solid brittle material designed to absorb the blast energy through several mechanisms including fracture and transfer blast energy through acceleration of the fractured solid brittle material. The HFRM serves to (1) absorb blast energy through a phase transformation, and (2) absorb blast energy through HFRM particle acceleration.

Additional Test Results

Figure 2A:
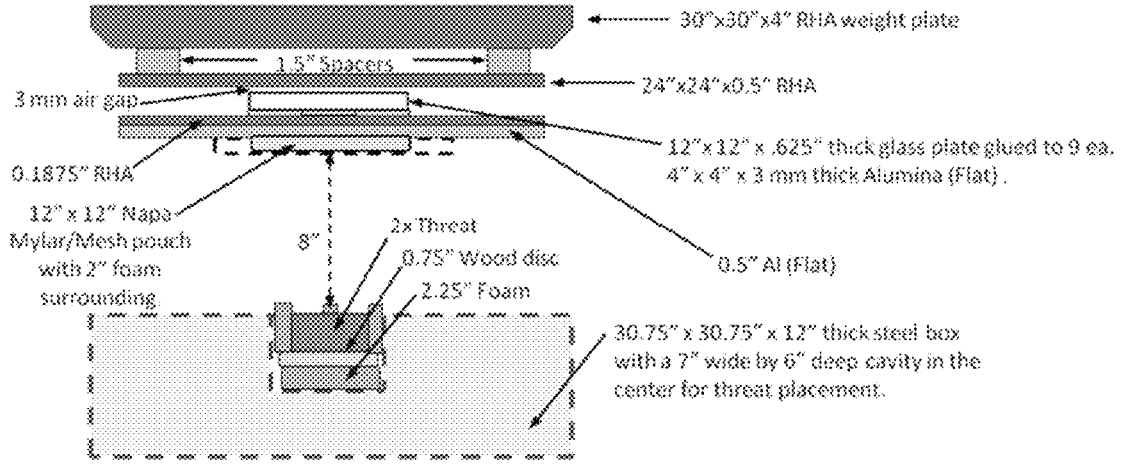
FIGS. 2A through 2C illustrate various test configurations used.
Figure 2B:
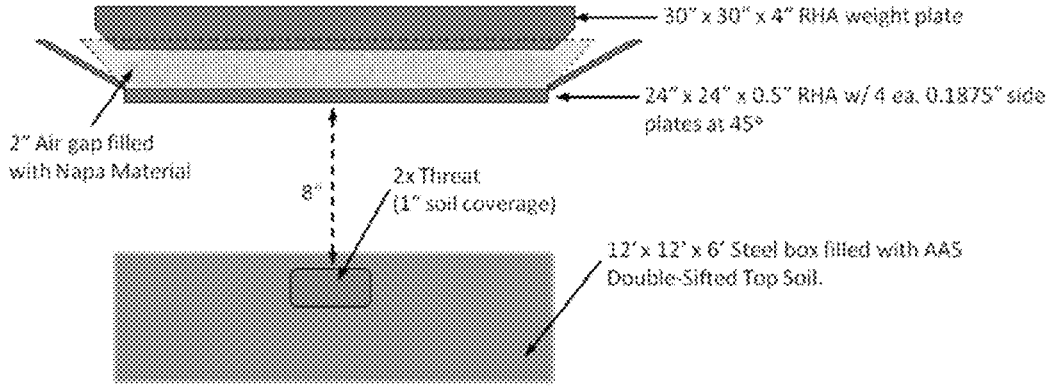
Figure 2C:
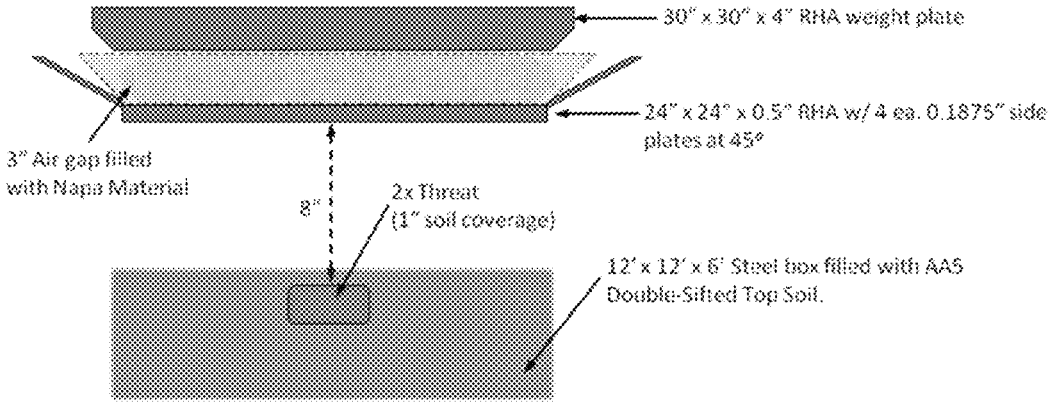

Additional blast testing was conducting using various configurations as shown in FIGS. 2A through 2C.

TABLE 1

Results of additional blast testing. Pot: Charge is placed in steel pot. Top of charge is level with ground. In Ground: Charge top is 1 inch below ground in water saturated soil

| Shot | Configuration | Location | Charge Size | Energy Reduction (%) | Impulse Reduction (%) |
|---|---|---|---|---|---|
| 31 | Sol. 3 - C (NAPA) | Pot | 2 × C4 | 19.7 | 7.2 |
| 41 | Solution 4 - EA (2" NAPA) | In Ground | 2 × C4 | 47.2 | 24.6 |

TABLE 1-continued

Results of additional blast testing. Pot: Charge is placed in steel pot. Top of charge is level with ground. In Ground: Charge top is 1 inch below ground in water saturated soil

| Shot | Configuration | Location | Charge Size | Energy Reduction (%) | Impulse Reduction (%) |
|---|---|---|---|---|---|
| 43 | Solution 4 - EA (3" NAPA) | In Ground | 2 × TNT | 27.0 | 10.6 |

For Shot 31, the target configuration (top to bottom) was as follows and is illustrated in FIG. 2A.

1. 30"×30"×4" thick RHA Weight
2. 1.5" Al Spacers
3. 24"×24"×0.5" RHA
4. 3 mm air gap
5. 12"×12"×0.625" Glass
6. 3 mm Alumina Amplifier—Flat (9 ea. 4"×4" tiles—3×3 grid)
7. 24"×24"×0.1875" RHA
8. 0.5" Al
9. 12"×12" NAPA Mylar/Mesh pouch with 2" foam surrounding Total Target Weight: 1,089.3 lbs.

For Shot 31, the target configuration (top to bottom) was as follows and is illustrated in FIG. 2B. Target Configuration (from top to bottom):

1. 30"×30"×4" thick RHA Weight
2. 2" Air gap filled with NAPA Material
3. 24"×24"×0.5" RHA Total Target Weight: 1,092.6 lbs.

For Shot 43, the target configuration (top to bottom) was as follows and is illustrated in FIG. 2C.

1. 30"×30"×4" thick RHA Weight (Previously used on Shot 41)
2. 3" Air gap filled with NAPA Material
3. 24"×24"×0.5" RHA Total Target Weight: 1,106.8 lbs All documents mentioned herein are hereby incorporated by reference for the purpose of disclosing and describing the particular materials and methodologies for which the document was cited.

Although the present invention has been described in connection with preferred embodiments thereof, it will be appreciated by those skilled in the art that additions, deletions, modifications, and substitutions not specifically described may be made without departing from the spirit and scope of the invention. Terminology used herein should not be construed as being "means-plus-function" language unless the term "means" is expressly used in association therewith.

What is claimed is:

1. An armor system, comprising:

a channel containing one or more solid bars of brittle material, a plunger having one end inside the channel and an opposite end operably connected to a first plate, and a high fluid retaining material (HFRM) behind a second plate affixed to an exterior surface of the first plate, wherein the armor system is configured such that upon impact of a blast shock wave upon the first plate, the first plate transfers the blast shock wave to the plunger and thence to the contents of the channel.

2. The armor system of claim 1, wherein the channel further contains a high fluid retaining material (HFRM).

3. The armor system of claim 1, further comprising a vehicle protected by the armor system.

4. The armor system of claim 1, wherein said first plate comprises metal, metal alloy, and/or metal matrix composite.

5. An armored vehicle comprising:

a first plate on the underside of the vehicle, a channel substantially orthogonal to the first plate and containing one or more solid bars of brittle material, a plunger having one end inside the channel and an opposite end operably connected to the plate, and a high fluid retaining material (HFRM) behind a second plate affixed to an exterior surface of the first plate, wherein the armor system is configured such that upon impact of a blast shock wave upon the first plate, the first plate transfers the blast shock wave to the plunger and thence to the contents of the channel.

6. The armored vehicle of claim 5, wherein the channel further contains a high fluid retaining material (HFRM).

7. The armored vehicle of claim 5, wherein said first plate comprises metal, metal alloy, and/or metal matrix composite.

* * * * *